US009414663B2

(12) United States Patent
Aso

(10) Patent No.: US 9,414,663 B2
(45) Date of Patent: Aug. 16, 2016

(54) COSMETIC APPLICATOR

(75) Inventor: Hironori Aso, Kanagawa (JP)

(73) Assignee: SINWA CORPORTION, Kanagawa (JP)

( * ) Notice: Subject to any disclaimer, the term of this patent is extended or adjusted under 35 U.S.C. 154(b) by 0 days.

(21) Appl. No.: 14/119,669

(22) PCT Filed: May 24, 2011

(86) PCT No.: PCT/JP2011/061813

§ 371 (c)(1),
(2), (4) Date: Nov. 22, 2013

(87) PCT Pub. No.: WO2012/160644

PCT Pub. Date: Nov. 29, 2012

(65) Prior Publication Data

US 2014/0076350 A1 Mar. 20, 2014

(51) Int. Cl.

| | |
|---|---|
| ***A45D 24/16*** | (2006.01) |
| ***A45D 40/26*** | (2006.01) |
| ***A45D 34/04*** | (2006.01) |
| ***A46B 3/00*** | (2006.01) |
| ***A46B 9/02*** | (2006.01) |

(52) U.S. Cl.

CPC ..... *A45D 34/042* (2013.01); *A45D 40/262* (2013.01); *A46B 3/005* (2013.01); *A46B 9/021* (2013.01); *A46B 2200/106* (2013.01); *A46B 2200/1046* (2013.01); *A46B 2200/1053* (2013.01)

(58) Field of Classification Search

CPC ..... A45D 24/16; A45D 19/02; A45D 44/18; A45D 40/262; A46B 2200/104; A46B 15/00; A46B 9/023

USPC ..... 132/120, 218, 161; 15/160

See application file for complete search history.

(56) References Cited

U.S. PATENT DOCUMENTS 1,010,913 A * 12/1911 Hope ..... 132/120
1,413,810 A * 4/1922 Tait ..... 132/120

(Continued)

FOREIGN PATENT DOCUMENTS

GB 1308015 A * 2/1973
JP Hei 7-3513 1/1995
JP 10-511290 A 4/1998

(Continued)

*Primary Examiner* — Robyn Doan
(74) *Attorney, Agent, or Firm* — Roberts Mlotkowski Safran Cole & Calderon, PC

(57) ABSTRACT

Provided is a tool for applying cosmetics for mascara and eyebrow cosmetics which allows applying a liquid cosmetic in an appropriate amount to eyelashes or eyebrows, and with which a previously unexperienced feeling of use can be obtained. In an application tool (1) for which a plurality of bristles (30) are fixed in a double-folded manner to the inside of a long groove (12), which is formed at a partial side surface of a brush portion (10) formed at a leading end side of a brush shaft (6), comb teeth (26) are integrally formed at a predetermined pitch in a brush portion axial direction on an exposed surface (21) of the fastener (20). As a result of forming the comb teeth (26) in a space that is wide between two lines of bristle groups (30*a*, 30*b*), the liquid pool space is narrowed accordingly, so that excessive pooling of a liquid cosmetic (2) in the brush portion (10) can be prevented. Also, as a result of the comb portion being formed between the bristle group 30*a* and the bristle group 30*b*, an application tool (1) with which a previously unexperienced feeling of use can be obtained can be provided.

3 Claims, 4 Drawing Sheets

(56) References Cited

U.S. PATENT DOCUMENTS

| | | | | |
|---|---|---|---|---|
| 1,481,588 | A * | 1/1924 | Churbuck | 132/120 |
| 2,816,557 | A * | 12/1957 | Sternberg | 132/120 |
| 5,865,556 | A | 2/1999 | Lhuisset | |
| 6,408,857 | B1 | 6/2002 | Neuner | |
| 2002/0011251 | A1 * | 1/2002 | Gueret | 132/218 |

FOREIGN PATENT DOCUMENTS

| | | |
|---|---|---|
| JP | 3101016 | 6/2004 |
| JP | 2004-504085 A | 12/2004 |
| JP | 2006-326081 | 12/2006 |
| JP | 2007-117368 A | 5/2007 |
| JP | 2010-155014 | 7/2010 |

* cited by examiner

COSMETIC APPLICATOR

TECHNICAL FIELD

The present invention relates to a tool for applying cosmetics for mascara and eyebrow cosmetics to be used for applying liquid cosmetics to eyelashes and eyebrows, and particularly, to a tool for applying cosmetics in a brush portion of which bristles made of animal and plant hairs, synthetic resin fibers, and the like are implanted in lines in an axial direction of the brush portion.

BACKGROUND ART

As this type of tool for applying cosmetics for mascara and eyebrow cosmetics, there has been provided one for which a base end portion of a rod-shaped brush shaft made of a resin is used as an operating portion, a long groove is formed parallel to the brush shaft at a partial side surface of a leading end side of the brush shaft, a plurality of bristles are disposed between the long groove and a rod-shaped resin fastener, and the bristles folded double in the long groove are fixed to the inside of the long groove along with the fastener, whereby a brush portion where bristles are implanted in two lines in the axial direction is formed (refer to Patent Literature 1). In this application tool, a liquid pool space is formed between a bristle group and a bristle group aligned in the brush portion axial direction, so that a liquid cosmetic retained in this space can be applied to eyelashes or eyebrows sufficiently.

CITATION LIST

Patent Literature 1

Japanese Published Unexamined Utility Model Application No. H07-3513 (FIG. 4, Paragraphs 0014 to 0015)

SUMMARY OF INVENTION

Technical Problem

However, in the application tool for mascara and eyebrow cosmetics of Patent Literature 1, first, there has been a problem that, because the space between the two lines of bristle groups is wide, the space retains an excessively large amount of liquid cosmetic, and the cosmetic applied is more than the amount the user intended. Second, there has been a problem that, because the liquid cosmetic adhered in the vicinity of the fastener exposed at a bottom portion between the two lines of bristle groups is not easily removed by a wiping portion provided in a surrounding manner at the side of a container containing the cosmetic, the cosmetic remains in a large amount, the cosmetic applied is more than the amount the user wishes also in this regard, and further, the liquid cosmetic remaining on the fastener is solidified, and is applied as solid chunks to eyelashes or the like when the application tool is used thereafter.

The present invention has been made in view of the problems of the conventional technique described above, and an object thereof is to provide a tool for applying cosmetics for mascara and eyebrow cosmetics which, even in a tool for applying cosmetics including a brush portion in a form where bristles are implanted in lines in an axial direction of the brush portion, allows applying a liquid cosmetic in an appropriate amount to eyelashes or eyebrows.

Solution to Problem

In order to achieve the above-described object, in a tool for applying cosmetics according to claim 1, which is a tool for applying cosmetics including a rod-shaped brush shaft a base end portion of which is provided as an operating portion, and a brush portion formed at a leading end side of the brush shaft, for the brush portion, by use of a long groove formed parallel to an axial direction of the brush portion at a partial side surface of the brush shaft and a rod-shaped fastener to be engaged with the long groove, a plurality of bristles disposed between the long groove and the fastener being fixed in a double-folded manner to inside of the long groove, and the bristles being implanted in two lines in the brush portion axial direction, on a surface of the fastener exposed from the long groove, comb teeth each extending in an extending direction of the bristles are formed at a predetermined pitch in the brush portion axial direction.

(Function) Because the comb teeth are formed between a bristle group and a bristle group imprinted in two lines in the brush portion, there is provided an application tool including, in the same direction (brush portion axial direction), an implanted brush portion formed of bristle groups and a comb portion formed of comb teeth.

Moreover, as a result of forming comb teeth in a space that is conventionally wide between bristle groups (in the brush portion cross direction), the liquid pool space is narrowed accordingly, so that excessive pooling of a liquid cosmetic can be prevented.

Moreover, because a liquid cosmetic pooling in a gap between the comb tooth and comb tooth can be applied to eyelashes or eyebrows, the liquid cosmetic retained in this gap is effectively used, and is also never solidified.

Further, when making up eyelashes using this application tool, by holding the operating portion so that the brush shaft becomes substantially parallel to the eyelashes, and operating the operating portion so as to lift the eyelashes with the brush portion, first, one bristle group contacts the eyelashes, and a mascara liquid retained by this bristle group is applied to the eyelashes, next, a liquid cosmetic retained between this bristle group and the comb portion and a liquid cosmetic retained in a gap between the comb tooth and comb tooth is further applied to the eyelashes, and the eyelashes are combed in the gap between the comb tooth and comb tooth, and lastly, the other bristle group contacts the eyelashes, and combs the eyelashes so as to separate one lash from another, and smoothes the applied mascara liquid on the eyelashes uniformly, and thus slender beautiful eyelashes are produced.

In claim 2, in the tool for applying cosmetics according to claim 1, the comb teeth are formed lower in height than the bristles.

(Function) For the bristles, after bristles are folded double and fixed to the inside of the long groove, both end portions of the bristles extending from the brush portion are cut into desired length pieces, and thus by forming comb teeth with a lower height than the height (length) of bristles desired as a tool for applying cosmetics, the comb teeth do not interfere while trimming, and the trimming can be smoothly performed.

Moreover, because the comb teeth are lower in height than the bristles, the comb teeth contact the root of eyelashes, and a liquid cosmetic retained in a gap between the comb tooth and comb tooth is applied more to the root of the eyelashes.

Advantageous Effects of Invention

By the invention according to claim 1, as a result of forming the comb portion in the liquid pool space, the liquid pool space never excessively retains a liquid cosmetic, and the liquid cosmetic can be applied to eyelashes or the like in an appropriate amount.

Moreover, because a liquid cosmetic never remains to become solidified in the liquid pool space produced in the gap between the comb tooth and comb tooth, the user also never feels discomfort.

Further, as a result of the comb portion being formed between the bristle group and bristle group, an application tool with which a previously unexperienced feeling of use can be obtained can be provided.

By the invention according to claim 2, as a result of making the height of extension (from the brush portion) of the comb teeth lower than the height of extension of the bristles, a smooth trimming process of the bristles can be performed.

Moreover, because a mascara liquid is applied more to the root of eyelashes, slender beautiful eyelashes can be produced with an eyeliner effect imparted to the eyes.

DESCRIPTION OF EMBODIMENTS

First Embodiment

Figure 1:
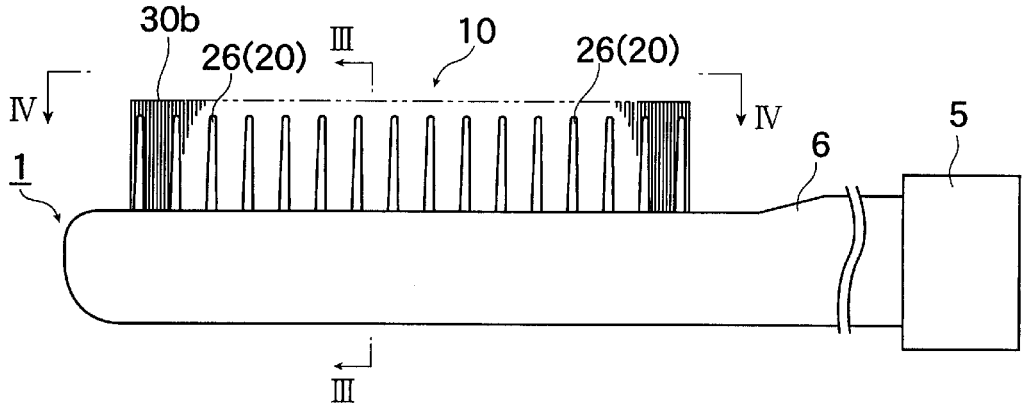
FIG. 1 is a front view of a tool for applying cosmetics according to a first embodiment of the present invention.
Figure 2:
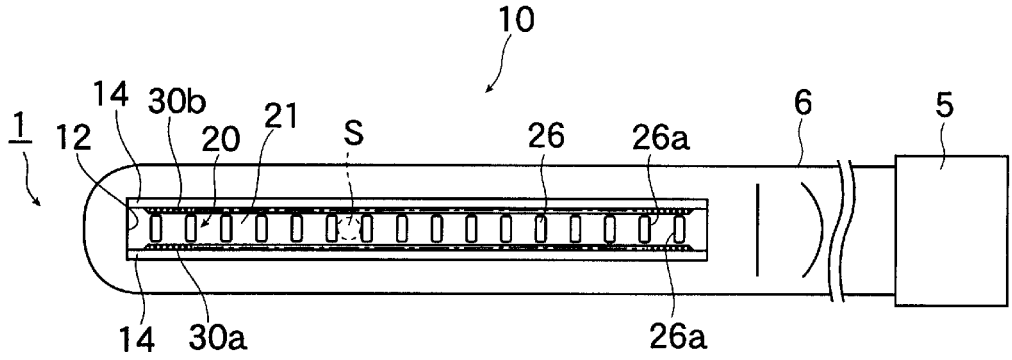
FIG. 2 is a plan view of the same application tool.
Figure 3:
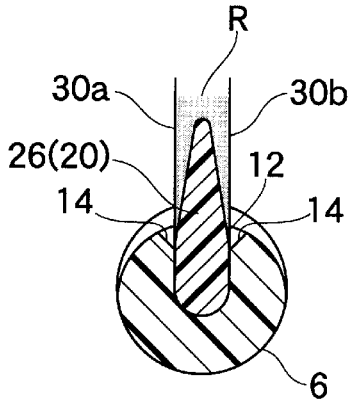
FIG. 3 is a cross-sectional view of the same application tool (a sectional view taken along a line III-III in FIG. 1).
Figure 4:
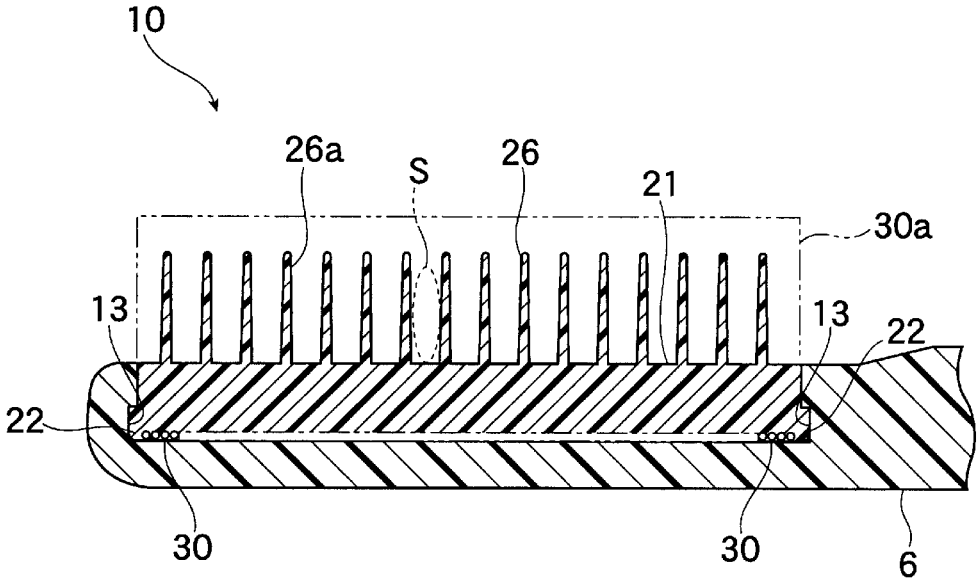
FIG. 4 is a longitudinal sectional view of the same application tool (a sectional view taken along a line IV-IV in FIG. 1).
Figure 5:
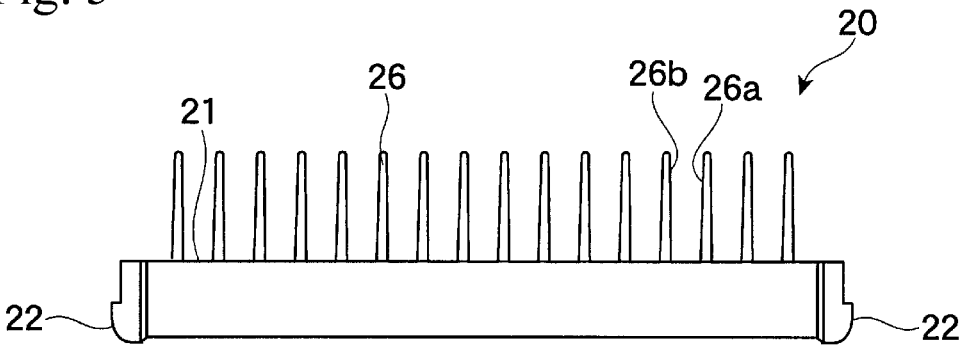
FIG. 5 is a front view of a fastener which is a main portion of the same application tool.
Figure 6:
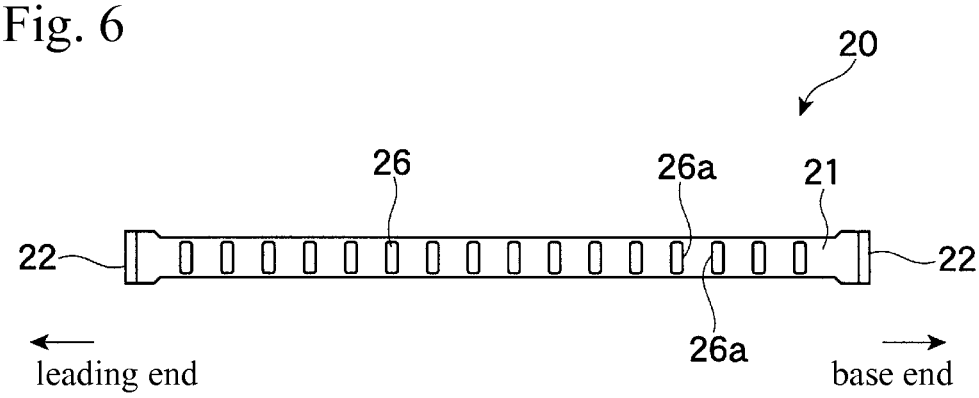
FIG. 6 is a plan view of the same fastener.
Figure 7:
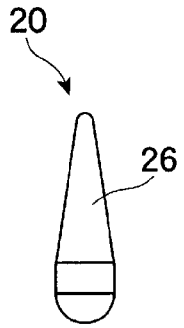
FIG. 7 is a right side view of the same fastener.

A first embodiment of a tool for applying cosmetics according to the present invention applied to an application tool for mascara will be described based on the drawings. FIG. 1 is a front view of a tool for applying cosmetics according to the first embodiment, FIG. 2 is a plan view of the same application tool, FIG. 3 is a cross-sectional view of the same application tool (a sectional view taken along a line III-III in FIG. 1), FIG. 4 is a longitudinal sectional view of the same application tool (a sectional view taken along a line IV-IV in FIG. 1), FIG. 5 is a front view of a fastener which is a main portion of the same application tool, FIG. 6 is a plan view of the same fastener, and FIG. 7 is a right side view of the same fastener. In addition, the imaginary lines in FIGS. 1, 2, and 4 show implanted bristles, and illustration of a bristle group 30*a* that would be seen at a nearer side is omitted in FIG. 1 so that comb teeth 26 can be seen.

As shown in FIG. 1, the tool for applying cosmetics 1 according to the first embodiment of the present invention includes a cylindrical rod-shaped brush shaft 6 made of a synthetic resin such as PP which is provided at its base end portion with an operating portion 5 serving also as a cap body of a cosmetic container 3 (not shown) housing a mascara liquid 2 as a liquid cosmetic, and a brush portion 10 for which, at a leading end side of the brush shaft 6, bristles 30 made of animal and plant hairs and synthetic resin fibers such as nylon are implanted in lines. Moreover, at an opening portion of the cosmetic container 3, a well-known wiping portion (wiper) 4 consisting of a shrinkable member such as rubber, which is for scraping off by a certain amount the mascara liquid 2 adhered to the brush portion 10, is provided in a surrounding manner.

At a partial side surface of the brush shaft 6 according to the brush portion 10, a long groove 12 recessed at its bottom portion in a round shape is formed parallel to a brush portion axial direction. At side surfaces of leading end and base end sides of the long groove 12, engaging grooves 13 for convex-concave lance engagement with convex portions 22 formed at the leading end and base end of a fastener 20 to be described later are formed, respectively. Also, the long groove 12 has a tapered portion 14 at its marginal portion in the brush portion axial direction, so that the fastener 20 can be easily inserted therein.

Moreover, in the long groove 12, via the fastener 20 that is in a rod shape roughly coincident with the shape of the long groove 20, a plurality of bristles 30 are fixed in a double-folded manner to the inside of the long groove 12. The fastener 20 is a synthetic resin mold made of PET and the like, is formed, at its side surfaces of the leading end and base end sides in the brush portion axial direction, with convex portions 22 to be engaged with the engaging grooves 13 of the long groove 12, respectively, and can thus be easily attached by convex-concave lance engagement when the fastener 20 is pushed into the long groove 12. Further, on a surface 21 of the fastener 20 that is exposed from the long groove 12 when the fastener 20 is fixed to the long groove 12, comb teeth 26 each extending in the same direction as an extending direction of the bristles 30 and being in a flat plate shape tapered to become thinner in thickness and narrower in width toward its leading end side are integrally formed at a predetermined pitch in the brush portion axial direction. In addition, each one comb tooth 26 has a plane portion 26*a* parallel to a plane portion 26*a* of another comb tooth 26, and each plane portion 26*a* extends in a direction perpendicular to the brush portion axial direction.

The bristles 30 use nylon of a diameter of 0.102 mm (4 mil) as an example, and are, in a form that central portions of the respective bristles 30 are fused and integrated into a group of bristles 30, fixed to the brush portion 10 as a result of the fastener 20 being fixed to the inside of the long groove 12, with the central portions being disposed between the long groove 12 and the fastener 20. Then, by cutting in length (trimming) both end portions of the bristles 30 extending in a direction perpendicular to the brush portion axial direction from the brush portion 10 to adjust the height (length) of the bristles 30 to a desired length, the brush portion 10 is implanted with a bristle group 30*a* and a bristle group 30*b* in two lines in the brush portion axial direction.

Further, because each comb tooth 26 is formed so that its height (to extend from the brush portion 10) is lower than the height (to extend from the brush portion 10) of the bristle groups 30*a*, 30*b*, the comb teeth 26 do not interfere while trimming of the bristles 30, and thus the foregoing trimming process can be smoothly performed.

As described above, there is provided an application tool 1 the brush portion 10 of which includes, in the same direction (brush portion axial direction), an implanted brush portion formed of bristle groups 30*a*, 30*b* and a comb portion formed of comb teeth 26 formed therebetween.

Then, when the brush portion 10 is inserted in the cosmetic container 3, the brush portion 10 is dipped into the mascara liquid 2, and when the brush portion 10 is pulled out, the mascara liquid 2 on the brush portion 10 of a part that makes contact with the wiping portion 4 of the container liquid 3 is scraped off by a certain amount, and the mascara liquid 2 is retained in a liquid pool space R produced between 'the bristle group 30*a* and the comb teeth 26' and 'the bristle group 30*b* and the comb teeth 26' of the brush portion 10 and a liquid pool space S produced in a gap between the comb tooth 26 and the comb tooth 26. That is, in the conventional brush portion, the entire space between the bristle group 30*a* and the bristle group 30*b* has served as a liquid pool space, whereas because the comb teeth 26 are formed there, the liquid pool space is narrowed accordingly, so that the mascara liquid 2 never excessively pools in the liquid pool space R.

Next, when applying the mascara liquid 2 to eyelashes using the application tool 1, by holding the operating portion 5 to dispose the brush shaft 6 substantially in parallel along the eyelashes, disposing a side surface of the brush portion 10 on the side where the bristle groups 30*a*, 30*b* and the comb teeth 26 are formed on a lower side of the eyelashes, and then operating the operating portion 5 to move the brush shaft 6 upward so as to be lifted, an appropriate amount of the mascara liquid 2 is applied to the eyelashes in the following procedure. That is, by operating the operating portion 5 so as to lift the eyelashes with the brush portion 10, first, one bristle group 30*a* contacts the eyelashes, and the mascara liquid 2 retained by this bristle group 30*a* is applied to the eyelashes. Next, at the comb teeth 26 being a comb portion, the mascara liquid 2 retained in the liquid pool space R between the bristle group 30*a* and the comb teeth 26 and the liquid pool space S between the comb tooth 26 and the comb tooth 26 is further applied to the eyelashes, and the eyelashes are combed in the gap S between the comb tooth 26 and the comb tooth 26. Lastly, the other bristle group 30*b* contacts the eyelashes, and the mascara liquid 2 in the liquid pool space R between the comb teeth 26 and the bristle group 30*b* is applied, and the bristle group 30*b* combs the eyelashes so as to separate one lash from another, and smoothes the applied mascara liquid 2 on the eyelashes uniformly, and thus slender beautiful eyelashes are produced. Moreover, because the comb teeth 26 are lower in height than the bristle groups 30*a*, 30*b*, the comb teeth 26 contact the root of the eyelashes, and the mascara liquid 2 is applied more to the root of the eyelashes.

Thus, according to the present embodiment, because the liquid pool space R between the bristle groups 30*a*, 30*b* never excessively retains the mascara liquid 2, the mascara liquid 2 can be applied to eyelashes in an appropriate amount. Moreover, because the mascara liquid 2 pooling in the liquid pool space S between the comb tooth 26 and the comb tooth 26 is applied to the eyelashes, the mascara liquid 2 retained in the liquid pool space S can be effectively used, and further, because the mascara liquid 2 never remains to become solidified in the liquid pool space S, the user also never feels discomfort. Further, as a result of the comb teeth 26 (comb portion) being formed in the space of the bristle groups 30*a*, 30*b*, a previously unexperienced feeling of use can be obtained with the application tool 1, as described above. Moreover, because the mascara liquid 2 retained in the liquid pool space S of the comb teeth 26 that is lower in height than the bristles 30 is applied more to the root of the eyelashes, slender beautiful eyelashes can be produced with an eyeliner effect imparted to the eyes.

Second Embodiment

Figure 8:
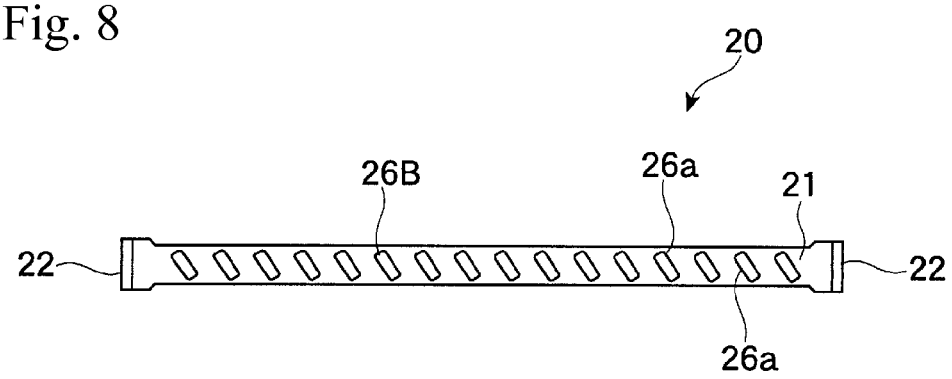
FIG. 8 is a plan view of a fastener of a tool for applying cosmetics according to a second embodiment.
Figure 9:
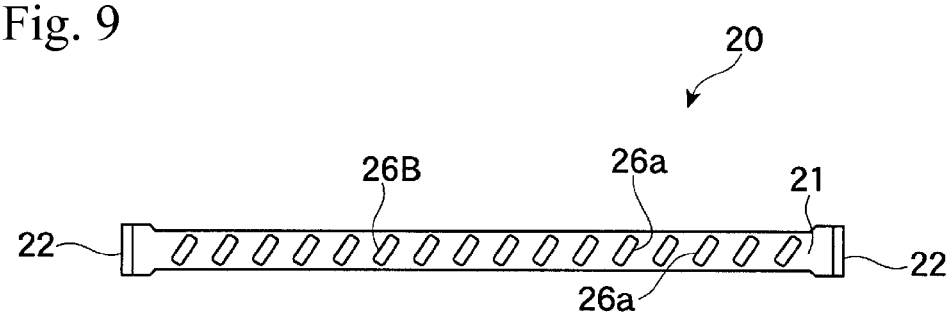
FIG. 9 is a plan view of a modification of the fastener according to the same embodiment.

Next, FIG. 8 is a plan view of a fastener of a tool for applying cosmetics according to a second embodiment. Because the second embodiment is the same as Embodiment 1 except that the comb teeth 26 of the fastener 20 in Embodiment 1 have changed to comb teeth 26B formed so as to be inclined with respect to the brush portion axial direction (the plane portions 26*a* of the comb teeth 26 are inclined at a predetermined angle with respect to the brush portion axial direction), description will be omitted by using the same reference signs. In addition, FIG. 9 is a plan view of a modification of the fastener 20 according to the same embodiment, and the inclination direction of the comb teeth 26B may be the direction in FIG. 9. This configuration allows providing an application tool 1 which, when applying the mascara liquid 2 to eyelashes using the application tool 1, can be used so as to lift the eyelashes with the plane portions 26*a* due to the inclination of the comb teeth 26B, and thus have the same effect as that of Embodiment 1 while easily catching eyelashes, and also providing a curling effect, and with which a feeling of use that suits the user's taste can be obtained.

Third Embodiment

Figure 10:
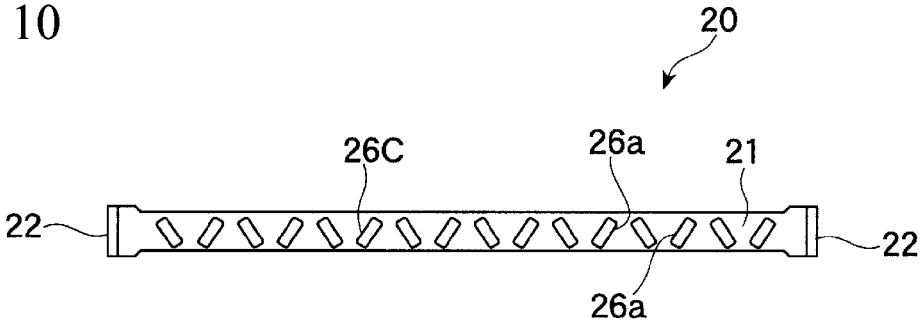
FIG. 10 is a plan view of a fastener of a tool for applying cosmetics according to a third embodiment.

Next, FIG. 10 is a plan view of a fastener of a tool for applying cosmetics according to a third embodiment, and the third embodiment is the same as Embodiment 2 except that the comb teeth 26B of the fastener 20 in Embodiment 2 have changed to comb teeth 26C formed in a mutually inclined form with respect to the brush portion axial direction. This configuration allows providing an application tool 1 which, when applying the mascara liquid 2 to eyelashes using the application tool 1, more easily catches eyelashes than Embodiment 2, and with which a feeling of use that suits the user's taste can be obtained.

Fourth Embodiment

Figure 11:
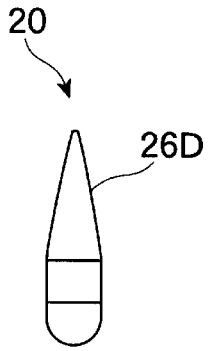
FIG. 11 is a right side view of a fastener of a tool for applying cosmetics according to a fourth embodiment.

Next, FIG. 11 is a right side view of a fastener of a tool for applying cosmetics according to a fourth embodiment, and the fourth embodiment is the same as Embodiment 1 except that the comb teeth 26 of the fastener 20 in Embodiment 1 each being in a flat plate shape have changed to comb teeth 26D each formed in a shape having a conical cross-section with respect to the brush portion axial direction. This configuration allows providing an application tool 1 where, as a result of becoming sharp angle shapes as compared with Embodiment 1, the comb teeth 26D have an enhanced effect to comb eyelashes, thereby creating a more natural looking finish, and with which a feeling of use that suits the user's taste can be obtained.

Fifth Embodiment

Figure 12:
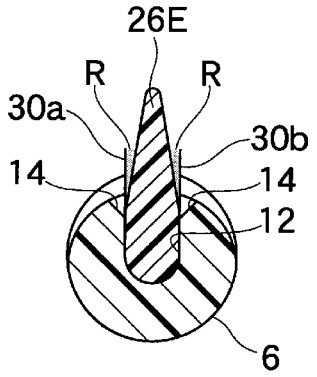
FIG. 12 is a cross-sectional view of a fastener of a tool for applying cosmetics according to a fifth embodiment.

Next, FIG. 12 is a cross-sectional view of a fastener of a tool for applying cosmetics according to a fifth embodiment, and the fifth embodiment is the same as Embodiment 1 except that the comb teeth 26 of the fastener 20 in Embodiment 1 have changed in height to comb teeth 26E formed higher than the height of the bristle groups 30*a*, 30*b*. This embodiment can be formed by adjusting bristles 30 to a target length at a stage prior to fixing to the inside of the long groove. This configuration allows providing an application tool 1 where, as a result of making the comb teeth 26E project further than the bristle groups 30*a*, 30*b*, the comb teeth 26E easily contact eyelashes, and accordingly, the mascara liquid 2 retained in the liquid pool space S between the comb tooth 26E and the comb tooth 26E is applied to eyelashes and the eyelashes are combed, one lash of the eyelashes is separated from another by the bristle group 30*b*, and slender beautiful eyelashes with mascara applied thinner than that by Embodiment 1 are produced, and thus with which a feeling of use that suits the user's taste can be obtained.

Figure 13:
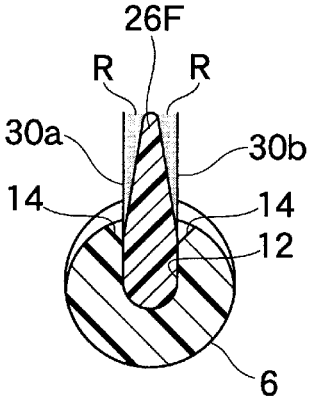
FIG. 13 is a cross-sectional view of a modification of the fastener according to the same modification.

In addition, FIG. 13 is a cross-sectional view of a modification of the fastener according to the same modification, and comb teeth 26F for which the comb teeth 26E are formed equal in height to the bristle groups 30*a*, 30*b* may be provided. This configuration allows providing an application tool 1 where the liquid pool space R between the bristle groups 30*a*, 30*b* and the comb teeth 26F is smaller than that of Embodiment 1 and larger than that of Embodiment 5, and thus with which a feeling of use that suits the user's taste in terms of the application amount can be obtained.

Although, in Embodiments 1 to 5, the application tool 1 is used as a tool for applying cosmetics for eyelashes, the application tool 1 can, as a matter of course, be used also as an application tool for eyebrow cosmetics that is used for eyebrows similarly.

REFERENCE SIGNS LIST

1 . . . application tool for applying cosmetics, 5 . . . operating portion, 6 . . . brush shaft, 10 . . . brush portion, 12 . . . long groove, 20 . . . fastener, 21 . . . surface exposed from long groove, 26, 26B, 26C, 26D, 26E, 26F . . . comb tooth, 26*a* . . . planar portion of comb tooth, 30 . . . bristle, 30*a*, 30*b* . . . bristle group, S, R . . . liquid pool space

The invention claimed is:

1. A tool for applying cosmetics, comprising:

a rod-shaped brush shaft, a base end portion of which is provided as an operating portion, and a brush portion formed at a leading end side of the brush shaft, a long groove formed parallel to an axial direction of the brush portion on a partial side surface of the brush shaft, a rod-shaped fastener engaged within the long groove, a plurality of bristles engaged between the long groove and the fastener being fixed in a double-folded manner to inside of the long groove by use of the long groove and the fastener, and mounted in two lines in the axial direction of the brush portion, and comb teeth each extending in an extending direction of the bristles and being formed on a surface of the fastener exposed from the long groove at a predetermined pitch in the axial direction of the brush portion and including side portions, wherein lower parts of the side portions of the comb teeth are in direct contact with the two lines of bristles but upper parts of the side portions of the comb teeth are spaced apart from the two lines of bristles.

2. The tool for applying cosmetics according to claim 1, wherein the comb teeth are lower in height than the bristles.

3. A tool for applying cosmetics, comprising:

a rod-shaped brush shaft, a base end portion of which is provided as an operating portion, and a brush portion formed at a leading end side of the brush shaft, a long groove formed parallel to an axial direction of the brush portion at on a partial side surface of the brush shaft, a rod-shaped fastener fixedly engaged within the long groove with respect to the longitudinal axis of the groove, a plurality of bristles engaged between the long groove and the fastener being fixed in a double-folded manner to inside of the long groove by use of the long groove and the fastener, and mounted in two lines in the axial direction of the brush portion, and comb teeth each extending in an extending direction of the bristles and being formed on a surface of the fastener exposed from the long groove at a predetermined pitch in the axial direction of the brush portion and including side portions, lower parts of the comb teeth being in direct contact with the two lines of bristles.

* * * * *